US005357930A

United States Patent [19]

Fehlmann et al.

[11] Patent Number: 5,357,930

[45] Date of Patent: Oct. 25, 1994

[54] FUEL INJECTION PUMP FOR INTERNAL COMBUSTION ENGINES

[75] Inventors: Wolfgang Fehlmann, Stuttgart; Wolfgang Braun, Ditzingen; Dieter Junger, Stuttgart, all of Fed. Rep. of Germany

[73] Assignee: Robert Bosch GmbH, Stuttgart, Fed. Rep. of Germany

[21] Appl. No.: 946,467

[22] PCT Filed: May 25, 1991

[86] PCT No.: PCT/DE91/00439

§ 371 Date: Nov. 12, 1992

§ 102(e) Date: Nov. 12, 1992

[87] PCT Pub. No.: WO91/19899

PCT Pub. Date: Dec. 26, 1991

[30] Foreign Application Priority Data

Jun. 20, 1990 [DE] Fed. Rep. of Germany ..... 4019642

[51] Int. Cl.[5] ..... F02M 37/04

[52] U.S. Cl. ..... 123/449; 123/502

[58] Field of Search ..... 123/449, 503, 494, 500, 123/501, 502

[56] References Cited

U.S. PATENT DOCUMENTS

| | | | |
|---|---|---|---|
| 4,586,480 | 5/1986 | Kobayashi | 123/503 |
| 4,604,979 | 8/1986 | Kobayashi | 123/449 |
| 4,873,956 | 10/1989 | Fehlmann | 123/503 |
| 5,000,668 | 3/1991 | Nakamura | 123/449 |
| 5,138,999 | 8/1992 | Fehlmann | 123/449 |

FOREIGN PATENT DOCUMENTS

| | | | |
|---|---|---|---|
| 3420345 | 12/1984 | Fed. Rep. of Germany . | |
| 3336871 | 4/1985 | Fed. Rep. of Germany . | |
| 0005423 | 1/1980 | Japan | 123/449 |

OTHER PUBLICATIONS

Patent Abstracts of Japan, vol. 12, No. 113 (M-683) (2960), 9 Apr., 1988 & JP-A-62 240 465 (Diesel Kiki) 21 Oct. 1987.

*Primary Examiner*—Carl S. Miller
*Attorney, Agent, or Firm*—Michael J. Striker

[57] ABSTRACT

A fuel injection pump has an inner chamber, a drive shaft extending into the inner chamber, a front cam plate setting a pump plunger into a reciprocating and rotating movement, a front face coupling which couples the drive shaft with the front cam plate, a roller ring provided with a plurality of rollers for supporting the cam plate, a rotational angle sensor including a stationary part and a sensor wheel formed as a movable part and arranged on the drive shaft radially opposite to the stationary part, a pivotable support ring having a part which axially overlaps the sensor wheel and carries the stationary part and a coupling part which couples the support ring with the roller ring and engages in a recess of the roller ring.

9 Claims, 1 Drawing Sheet

FUEL INJECTION PUMP FOR INTERNAL COMBUSTION ENGINES

BACKGROUND OF THE INVENTION

The present invention relates to a fuel injection pump for internal combustion engines.

More particularly, it relates to a fuel injection pump which has a drive shaft extending into an inner chamber and connected by a front face coupling with a front cam plate which sets a pump plunger into a reciprocating and rotating movement with the cam plate running on rollers of a roller ring, and a rotational angle sensor is provided in the pump. Such a fuel injection pump is known from the DE-OS 33 36 871, in which the fixed sensor part is directly and firmly fixed to the roller ring and lies radially opposite the sensor wheel on the drive shaft. For purposes of centering, the fixed sensor part can be displaced and re-fixed in the circumferential direction on the roller ring. This solution has the disadvantage that there is play between the roller ring bearing and the fuel injection pump housing, allowing movement of the roller ring in its radial plain, when forces act upon it when cams of the cam plate ride up on the rollers. Due to the fact that the roller ring is adjustable via the injection timing bolt, the bolt represents a one-sided bearing point for the roller ring, so that when it is loaded by forces in its circumferential direction, the roller ring carries out tipping movements around the bolt fulcrum. Moreover, the bolt fulcrum itself also has play, and the bolt itself can give to a certain extent, via the injection timing gear, when loaded by forces at right angles to the length of the bolt. On loading of the roller ring, its fulcrum additionally performs a movement in the circumferential direction. Where the stationary sensor part is fixed on the roller ring, it performs this movement in unison with the roller ring. For reasons of space and accommodation, the stationary sensor is usually arranged diametrically opposite the fulcrum point of the bolt. In this region, the movement components of the roller ring are greatest during its movement around the bolt. This then results in unintentional or erroneous measurements due to the fact that the stationary sensor part actually moves in a circumferential direction around the sensor wheel, and this causes incorrect timing of the fuel injection commencement. Depending on operating conditions, this error accumulates, either positively or negatively, causing the measuring result and the resultant injection commencement timing to be affected with an uncontrolled error. If the logging of the revolutionary speed, which is required for the volume calculation, lies within the relevant range, then this angle error has the effect of an error in the revolutionary speed, in turn making the volume calculation wrong.

SUMMARY OF THE INVENTION

Accordingly, it is an object of the present invention to provide a fuel injection pump of the above mentioned type, which avoids the disadvantage of the prior art.

In keeping with these objects and with others which will become apparent hereinafter, one feature of the present invention resides, briefly stated, in a fuel injection pump in which, axially adjacent to the sensor wheel on the drive shaft, a support ring is pivoted and has a part axially overlapping the sensor wheel, on which part the stationary part of the sensor is arranged, and the support ring is coupled with the roller ring via a coupling part which engages in a recess of the roller ring.

When the fuel injection pump is designed in accordance with the present invention, it has the advantage, that assisted by the support ring, the movement of the roller ring due to reactive forces of the cam drive can be cancelled out in terms of measuring techniques, or at the very least can be rendered largely ineffective.

In accordance with another embodiment of the present invention, the coupling part is arranged in the region between the bolt which engages on the roller ring and which lies opposite the stationary sensor part. Such a design provides for an advantageous arrangement of the coupling part for the coupling of the support ring with the roller ring. It is still another feature of the present invention that the coupling part has a movement path which is determined by the radial guide faces of the recess. With such a construction the roller ring's own movements can be virtually eliminated altogether with regard to the measuring position of the stationary sensor part, due to the reactive forces coming from the cam drive.

In accordance with another embodiment of the present invention, the coupling part is a pin which protrudes at approximately 90° angular separation radially from the bolt on the support ring and engages in radially aligned groove of the roller ring. Such a construction provides an arrangement of the coupling part which is easily located and manufactured, and which is effective. The drive shaft can have a support collar which is bordered toward the coupling on the front cam plate side by another collar and on which the sensor wheel can be radially and axially secured and in which support ring can be guided such that it can be turned between the sensor wheel and a part which runs onto the collar on the drive shaft side. The support ring can have parts which embrace the sensor wheel and which come to rest against it on the front face which faces away from the support ring. The drive shaft can have a support collar which is internally bordered by a collar toward the front cam plate side coupling and on which the sensor wheel is radially and axially secured and the support ring is rotatably guided between the collar and the sensor wheel. These features provide for advantageous bearing options for the support ring and its fixation in respect of the movement of the stationary sensor part relative to the sensor wheel.

The arrangement of the support ring having parts which embrace the sensor wheel is especially advantageous.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
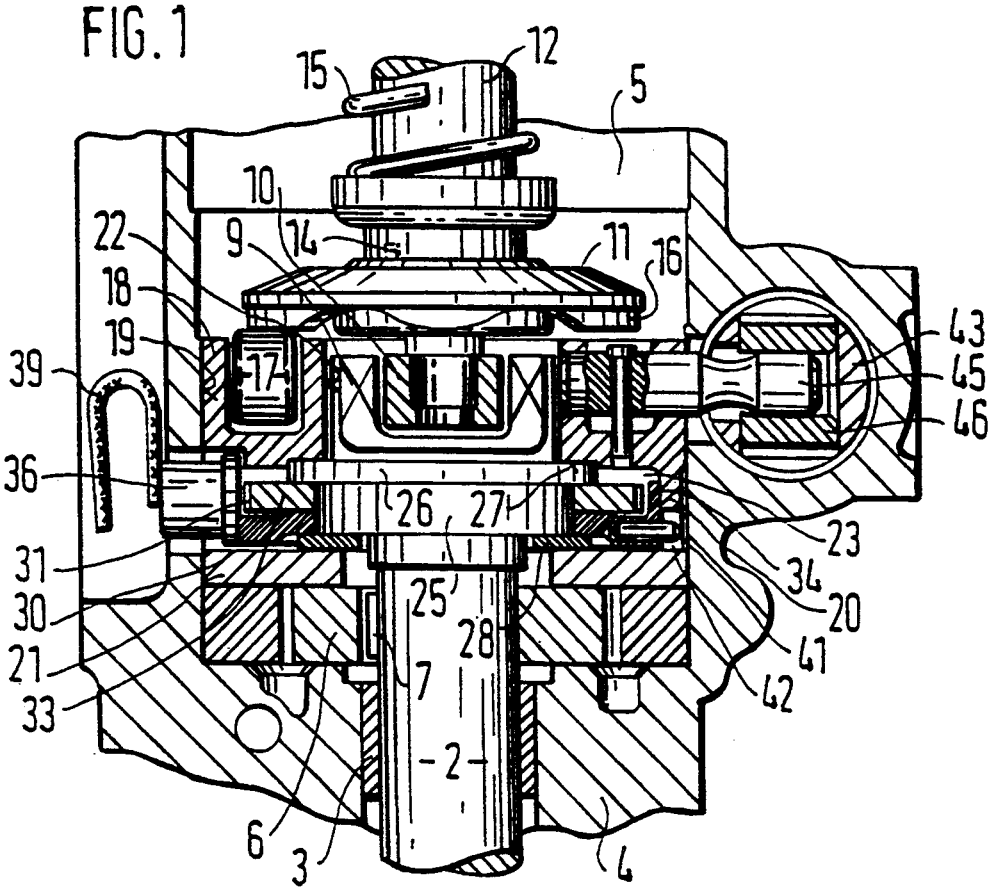
FIG. 1 shows a partial section along the axis of the drive shaft of a distributor fuel injection pump with the parts arranged in accordance with the invention.

FIG. 1 shows a partial section through a distributor fuel injection pump along the axis of its drive shaft 2, which is supported with plain bearings 3 in the wall of the housing 4 of the distributor fuel injection pump, In its interior, the housing encloses a pump chamber 5, which is filled with pressurized fuel, The filling of the chamber is achieved by means of a delivery pump 6 which is driven by the drive shaft via a feather key 7 and which is inside the pump housing, The end of the drive shaft has at its front face a claw pair 9, which drives a front cam plate 11 in a rotary motion via a carrier 10 and via appropriate claws, which are not shown. A pump plunger 12 is coupled in a known manner with the front cam plate via a pin 14, which is held at the front face by a spring 15 to rest against the front cam plate 11. The cams 16 of the front cam plate run over rollers 17, which are supported in a roller ring 18 in a radial direction. With its circular outer contour, the latter is supported so as to be rotatable, in an appropriate cylindrical recess 19 of the pump housing, supporting itself axially via an apron 20 and its front face against a plate 21 which covers the delivery pump 6. The central breakthrough 22 of the roller ring is used to allow the claws 9 of the drive shaft to pass through, and for accommodating the coupling between the drive shaft and the pump plunger with the carrier piece and the claws of the cam plate 11. In the region of the apron 20, the roller ring, together with the plate 21, encloses a cylindrical space 23, into which the drive shaft 2 projects. This has a support collar 25, which is restricted against a final collar 26 by the claw pair. This final collar has a larger diameter than the support collar and abuts on the front face 27 of the roller ring 18 which borders the space 23. An intermediate disc 28 is further placed between the plate 21 and the support collar 25, closing off the support collar on the drive shaft side. Adjacent to the collar 26, a sensor wheel 30 is sweated onto the support collar in the space between the intermediate disc 28 and the collar 26, which is provided with teeth 31 on its front face circumference. A support ring 33, which is rotatable, is arranged alongside the sensor wheel towards the intermediate disc 28 and is axially secured between the intermediate disc 28 and the sensor wheel. The support ring has a ring wall 34 which axially encompasses the sensor wheel 30 and on which a stationary part 36 of a rotational angle sensor is arranged, which with its active side acts in conjunction with the teeth 31 of the sensor wheel 30 and abuts opposite the latter in a radial direction. The stationary sensor part is connected via this cable connection 39 with an electronic control unit, not shown here.

The support ring further has a radially projecting pin 41, which projects with as little play as possible into a groove 42 in the apron 20 of the roller ring, thus serving the coupling of the support ring with the roller ring. This pin is arranged at an angular separation of 90° from the stationary sensor part 26 and, for reasons of representation, is included in FIG. 1 in a "laid-over" presentation.

The roller ring is rotatable in a known manner, by an injection timing plunger 43. To do this, the roller ring is coupled with the injection timing plunger 43 via a bolt 45 which extends radially towards the drive shaft. The bolt is fixed in the usual way in the roller ring and coupled by means of a pivoted connection with the injection timing plunger 43 via a sliding block 46.

In the operation of the fuel injection pump, the drive shaft 2 is set into a rotary motion, while at the same time, the delivery pump 6 is set in motion and the pump chamber 5 is supplied with pressurized fuel, the pressure of which depends on the number of revolutions. This fuel also acts on the injection timing plunger 43 against a return spring, not shown here, further adjusting this plunger as the rotational speed increases. The resulting turning of the roller ring has the effect that the cam plate is set into its delivery stroke movement during riding up on rollers 17 at an ever earlier point in time. The pump plunger 12 of this distributor injection pump carries out several delivery strokes in the usual way per revolution of the drive shaft, depending on the number of fuel injection valves requiring to be supplied per revolution. The cam plate 11 has several cams which also become active with the rollers 17 which are distributed around the circumference of the roller ring. During the stroke of the cam plate against the force of the spring 15 and the pressure prevailing in the pump working chamber in front of the pump plunger 12, there are forces acting on the rollers and the roller ring, which corresponding to the cam course also become effective in circumferential direction. This effects on the one hand a turn-back moment on the injection timing plunger, whilst on the other hand causing a movement of the roller ring itself within its guide clearance in the cylindrical recess. However, if the roller ring is assumed to be retained on the bolt 45, then it can, by virtue of the play in the radial plain of the roller ring, tilt around the bolt as a fulcrum. Superimposed on this tilting movement is the play-affected connection between the bolt 45 and the roller ring or the timing plunger. With each delivery stroke of the pump plunger, therefore, the roller ring carries out transverse movements in its radial plain within the confines of the specified play.

With normal pumps, this is not generally a problem. However, problems-will arise when the roller ring, as a stationary part of an angle sensor is required to determine the rotational position of a moving part of the angle sensor. The torsion undertaken by the injection timer for the adjustment of the injection commencement is to be fed back to an electrical control device, namely in relation to an imagined rotational position of the drive shaft, which revolves synchronously with the cams of the cam plate. Seen in this way, the endeavour is to ascertain to which points of the cam stroke curve, relative to the drive shaft which is driven synchronously with the speed of the internal combustion engine, the injection takes place. In addition, the momentary revolutionary speed as required for the volume calculation, is to be ascertained which, if it coincides with the "tilting" , can cause a volume error.

The movable part of the angle sensor, the sensor wheel 30, imparts to the stationary sensor part 36 via the teeth 31, the revolution of the drive shaft and the rotational angle distance, which is required by a reference mark in order to achieve overlapping with the stationary sensor part, with the rotational angle position of the reference mark relative to the base cam being produced in a defined manner. If, as described above, the stationary sensor part moves to and fro with the roller ring, then there will be no precise results. For this reason, the stationary sensor part 36 is arranged on the support ring 33, and this is supported on the drive shaft and coupled to the roller ring in the manner described. The position of the coupling pin 41 at 90° separation from the clamping point on the bolt 45 which is diametrically opposite the stationary sensor part 36, has the effect that in a tilting movement of the roller ring within the radial plain, the timing component in the circumferential direction on the support ring becomes negligibly small. In this arrangement, both the avoiding movement of the roller ring in the region of the bolt 45 and the tilting movement around the bolt 45 or the injection timing plunger 43, are taken into account. In principle, the requirement is that the coupling pin should be arranged and aligned such that it is arranged and aligned on the roller ring axis in the direction of the perpendicular of the bolt 45. The groove must therefore be designed or arranged correspondingly.

Figure 2:
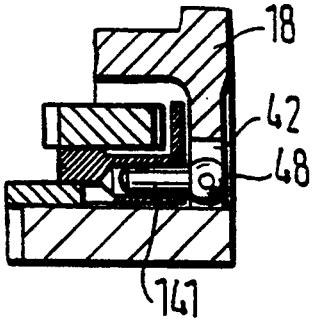
FIG. 2 shows a partial section in accordance with the cross-section of FIG. 1 in a first modified embodiment as a second embodiment example.

In a variant of the embodiment example of FIG. 1, the pin 141 shown in FIG. 2, which corresponds to the pin 41 in FIG. 1, is provided with a spherical head 48, which projects with movement clearance into the groove 42 of the roller ring 18. This has the advantage that the play between pin 41 and roller ring 18 can be kept smaller still, since compensation of alignment errors, in particular in the event of tilting movements of the roller ring 18, is still possible by means of the head 48.

Figure 3:
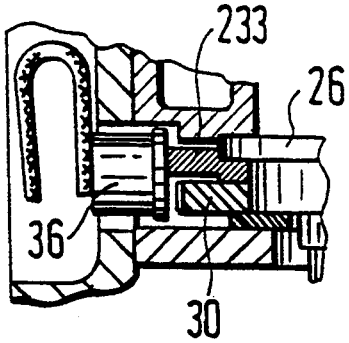
FIG. 3 shows a section in accordance with the cross-section in FIG. 1 of a second modified form as a third embodiment example.

To guide the support ring 233 axially with greater measuring accuracy, the support ring in the embodiment example of FIG. 3 is fitted between the collar 26 and the sensor wheel 30 with the least possible play and with free movability in, the circumferential direction.

Figure 4:
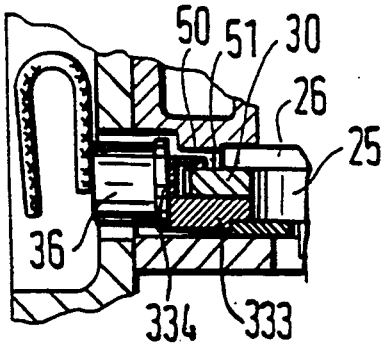
FIG. 4 shows a partial section in accordance with the section in FIG. 1 with a fourth embodiment example of the invention.

A more precise guidance is possible in accordance with the embodiment example of FIG. 4, where the support ring on the ring wall 334 has parts 50 which radially project inwards and embrace the sensor wheel 30 and which come to rest against that front face 51 of the sensor wheel which faces away from the support ring 333. Such overlapping parts 50 are arranged at several places dispersed around the circumference of the support ring 333, such that the sensor wheel 30 can still be inserted and then, together with the support ring, shrunk onto the support collar 25. In this solution, an exact arrangement of the stationary sensor part 36 in an axial direction to the sensor wheel 30 is ensured, enabling a very uniform sensor signal to be produced and fault influences from an axial offset to be avoided.

The arrangement of the support ring 33, 233, 333 on the drive shaft 2 has the advantage that the wear on the friction bearings 3 caused by the operation of the pump and the consequential drive shaft tilting does not alter the separation between the sensor wheel 30 and the sensor part 36, so that the signal strength remains constant over the entire life.

The simultaneous axial arrangement makes it possible to reduce the width of the sensor wheel 30 to a minimum (manufacturing advantages) without the teeth —due to drive shaft axial play —being allowed to come out of overlapping to the active sensor part, which would also cause a deterioration of the signal strength.

It will be understood that each of the elements described above, or two or more together, may also find a useful application in other types of constructions differing from the types described above.

While the invention has been illustrated and described as embodied in a fuel injection pump for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fuel injection pump, comprising means forming an inner chamber; a drive shaft having an axis and extending into said inner chamber; a front cam plate setting a pump plunger into a reciprocating and rotating movement; a front face coupling which couples said drive shaft with said front cam plate; a roller ring provided with a plurality of rollers for supporting said cam plate; a bolt which sets a position of said roller ring; an injection timer connected with said roller ring; a rotational angle sensor including a stationary part, and a sensor wheel formed as a movable part and arranged on said drive shaft radially opposite to said stationary part; a rotatable support ring extending completely around said axis and having a part which axially overlaps said sensor wheel and carries said stationary part; and a coupling part which couples said support ring with said roller ring and engages in a recess of said roller ring, said stationary part of said sensor being located at one side of said axis while said coupling part is located at another opposite side of said axis.

2. A fuel injection pump as defined in claim 1; and further comprising a housing which forms said inner chamber, said roller ring being pivoted in said housing.

3. A fuel injection pump as defined in claim 1, wherein said coupling part is arranged in a region between said bolt and said stationary sensor part.

4. A fuel injection pump as defined in claim 1, wherein said recess of said roller ring has radial guide faces, said coupling part having a movement path which is determined by said radial guide faces of said recess.

5. A fuel injection pump as defined in claim 9, wherein said roller ring has a radial groove, said coupling part being formed as a pin which protrudes radially on said support ring at approximately 90° angular distance from said bolt and engages in said radial groove of said roller ring.

6. A fuel injection pump as defined in claim 5, wherein said pin has a head which is spherical and engages in said radial groove of said roller ring.

7. A fuel injection pump as defined in claim 1, wherein said drive shaft has a support collar provided with a collar part facing said coupling, said support collar having a part located at a side of said drive shaft and arranged so that said support ring is rotatably guided between said sensor wheel and said part of said support collar.

8. A fuel injection pump as defined in claim 7, wherein said support ring has a further part which embraces said sensor wheel and abuts against a surface of said sensor wheel which faces away from said support ring.

9. A fuel injection pump as defined in claim 1, wherein said drive shaft has a support collar with a collar part facing said coupling of said front cam plate, said sensor wheel being radially axially secured on said support collar, said support ring being rotatably guided between said support collar and said sensor wheel.

* * * * *